US006532757B2

(12) United States Patent
Holzer et al.

(10) Patent No.: US 6,532,757 B2
(45) Date of Patent: Mar. 18, 2003

(54) COOLING DEVICE FOR INSTALLATION IN A FURNITURE NICHE

(75) Inventors: Stefan Holzer, Giengen (DE); Wolfgang Kentner, Röfingen (DE); Jürgen Hirath, Bayreuth (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/933,048

(22) Filed: Aug. 20, 2001

(65) Prior Publication Data

US 2002/0014086 A1 Feb. 7, 2002

Related U.S. Application Data

(63) Continuation of application No. PCT/EP00/01080, filed on Feb. 10, 2000.

(30) Foreign Application Priority Data

Feb. 19, 1999 (DE) ..... 199 07 077

(51) Int. Cl.[7] ..... F25D 15/00

(52) U.S. Cl. ..... 62/331; 62/259.1; 62/302; 62/263; 62/261; 62/448

(58) Field of Search ..... 62/259.1, 302, 62/263, 261, 448, 331

(56) References Cited

U.S. PATENT DOCUMENTS

| | | | | |
|---|---|---|---|---|
| 1,769,115 A | | 7/1930 | Davenport | |
| 3,079,770 A | | 3/1963 | Brown et al. | |
| 3,650,122 A | * | 3/1972 | Lieberman | 62/298 |
| 3,785,168 A | | 1/1974 | Domingorene | |
| 4,719,764 A | * | 1/1988 | Cook | 62/261 |
| 5,355,693 A | * | 10/1994 | McConnell et al. | 62/2.44 |
| 5,400,612 A | * | 3/1995 | Hedges | 62/171 |
| 6,148,629 A | * | 11/2000 | Boxum | 62/239 |
| 6,318,098 B1 | * | 11/2001 | Boxum | 62/183 |

FOREIGN PATENT DOCUMENTS

| | | |
|---|---|---|
| EP | 0 383 221 A2 | 8/1990 |
| EP | 0 659 367 A1 | 6/1995 |
| GB | 2 310 034 A | 8/1997 |

* cited by examiner

*Primary Examiner*—William C. Doerrler
*Assistant Examiner*—Mark Shulman
(74) *Attorney, Agent, or Firm*—Laurence A. Greenberg; Werner H. Stemer; Ralph E. Locher

(57) ABSTRACT

A cooling device for installation in a furniture niche includes at least one thermally insulating container defining a cooling space and having a door for sealing the space, and a cooler having a compressor, a condenser, and a ventilator. The base has at least two sidewalls, a front region disposed near the door, a rear region, at least one air supply aperture at the front region, and an exhaust aperture at the rear region. The base houses the compressor, condenser, and ventilator. The base is disposed below the cooling space and is force ventilated by the ventilator through the air supply aperture and the exhaust aperture. The exhaust aperture is in at least one of the sidewalls, preferably, in the rear region of the base averted from the door. Preferably, the cooling device is installed in a furniture niche of a kitchen unit.

8 Claims, 2 Drawing Sheets

COOLING DEVICE FOR INSTALLATION IN A FURNITURE NICHE

CROSS-REFERENCE TO RELATED APPLICATION

This application is a continuation of copending International Application No. PCT/EP00/01080, filed Feb. 10, 2000, which designated the United States.

BACKGROUND OF THE INVENTION

Field of the Invention

The invention relates to a cooling device for installation in a furniture niche of a kitchen unit or the like. The device includes at least one thermally insulating cooling space, which can be sealed by a door, and a base disposed therebeneath. The base serves to accept assemblies such as compressors, ventilators, and so on, and is force ventilated by the ventilator by way of at least one air inlet in the front region at the door side. To achieve an optimal volume of cooling space in built-in cooling devices, the prior art equips them with what is referred to as a base, within which the condenser/liquifier and the ventilator are disposed. As a result, these assemblies reduce the volume of the cooling space only marginally, if at all.

U.S. Pat. No. 3,142,162 to Herndon et al. describes such a cooling device. In the Herndon cooling device, a base is provided under the cooling space, the back of which accepts a compressor, a condenser, and a ventilator that force ventilates these assemblies. The ventilator supplies cool air to the assemblies that must be cooled by way of an air supply vent in the front region at the door side and an adjoining air inlet channel. The ventilator removes the hot air through an exhaust channel at its mouth and an exhaust vent in the front region at the door side. To prevent a short, which substantially degrades the cooling of the assemblies, a separating wall is provided in the base, which extends from the openings in the door-side front region into the rear region serving for receiving the assemblies. Thus, the wiring of the base is subdivided into two sections. However, the subdivision of the base interior substantially limits the possibility for configuring the assemblies suitably for cooling. In such regard, the condenser must be positioned on the air supply side to be able to cool it sufficiently to achieve an acceptable level of effectiveness for the cooling device. A consequence of such a function-specific configuration is that the condenser occupies a width of the air supply section to limit the area of the heat exchange surface of the condenser, particularly when the height of the base is fixed to a maximum value for optimizing the cooling space volume. Another consequence of the electrical subdivision is that the amount of cool air, which is necessary for cooling the assemblies, is only available when the air is moved along the channels at a relatively high velocity. Consequently, floating particles, which are commonly present in the standing area of a cooling device, are drawn into the base region and settle on the surface of the condenser (which is wound into several layers), causing the heat exchange characteristics to deteriorate substantially over the service life of the cooling device. Such deterioration results in a notable reduction of the effectiveness of the device. An additional reduction of the effectiveness derives from configuring the supply and exhaust openings immediately adjacent one another, because, with such a configuration, hot air that exits at the exhaust opening cannot be prevented from being drawn in again through the supply opening, at least to some extent, so that the preheated air is used to cool the condenser.

SUMMARY OF THE INVENTION

It is accordingly an object of the invention to provide a cooling device for installation in a furniture niche that overcomes the hereinafore-mentioned disadvantages of the heretofore-known devices of this general type and that provides at least one exhaust aperture in the back region of one of the walls of the base that is averted from the door.

With the foregoing and other objects in view, there is provided, in accordance with the invention, a cooling device for installation in a furniture niche, including at least one thermally insulating container defining a cooling space and having a door for sealing the cooling space, and a cooling apparatus including a compressor, a condenser, and a ventilator. The base has at least two sidewalls, a front region disposed in a vicinity of the door, a rear region, at least one air supply aperture disposed at the front region, and an exhaust aperture disposed at the rear region. The base houses the compressor, the condenser, and the ventilator. The base is disposed below the cooling space. The base is force ventilated by the ventilator through the at least one air supply aperture and the exhaust aperture. The exhaust aperture is disposed in at least one of the sidewalls. Preferably, the cooling device is installed in a furniture niche of a kitchen unit.

On one hand, the spatial separation of the air supply aperture from the exhaust aperture prevents the cool air that is drawn in by way of the supply aperture from mixing with the exhaust air that has already been heated in the process of cooling of the assemblies, and thereby noticeably improves the cooling of the assemblies and also the effectiveness of the device. Furthermore, because the supply and exhaust apertures are spatially separated, it is possible to forgo a channel formation within the interior of the base. Thus, the device assemblies are configurable in the base for optimum effectiveness. Moreover, because the electrical subdividing in the interior of the base is forgone, a larger air supply cross-section is possible, and the cool air that is required for sufficient cooling of the device assemblies can be transported at a low velocity. The low velocity produces a substantially reduced drag of particles into the interior of the base, which results in a substantially lower degree of contamination of the interior of the base and, thus, of the condenser. Accordingly, the heat exchange characteristics of the condenser are maintained nearly over the entire service life of the cooling device. It is particularly expedient when the exhaust aperture is disposed sitting in the rear region at one of the walls of the base, as provided in a preferred exemplifying embodiment of the invention.

According to a separate preferred embodiment of the invention, the exhaust aperture is disposed at least at one of the side walls of the base. With such a configuration of the exhaust aperture, it is already sufficiently spatially separated from the supply aperture so that a heating of the cool air streaming in through the supply aperture by the hot exhaust air that is removed from the exhaust aperture is at least substantially prevented to the benefit of a substantial improvement of the effectiveness of the cooling system. Additionally, an air throughput through the exhaust aperture, which is sufficient for cooling the assemblies, is easily achievable.

In accordance with another feature of the invention, there are at least two exhaust apertures, the sidewalls each have a sidewall rear region in a vicinity of the rear region of the base, and at least one of the exhaust apertures is disposed in the sidewall rear region of one of the sidewalls.

At least one respective exhaust aperture is provided at the sidewalls in the back region of the base. As such, a particularly minimal particle drag into the base space is achieved. Furthermore, the exhaust removal is substantially faster given constant ventilator power. The exhaust apertures are disposed particularly expediently with respect to a spatial separation of the supply and exhaust apertures when, in accordance with a further feature of the invention, the exhaust apertures are disposed at the sidewalls of the base immediately adjacent to its back wall.

In accordance with an added feature of the invention, at least one exhaust aperture is disposed at the back side of the base. By virtue of the configuration of the exhaust aperture, the hot air is reliably prevented from mixing into the cool air serving for the cooling of the assemblies, thereby increasing the effectiveness of the cooling system even further.

In accordance with an additional feature of the invention, the front region of the base has a front wall defining the at least one supply aperture, the front wall has a width, and the supply aperture extends at least substantially across the width of the front wall.

With such a base construction, a particularly large exhaust feed is possible given a low airspeed. Furthermore, it becomes possible to tune the width of the condenser, for example, to the width of the air supply aperture, whereby the condenser is cooled particularly intensively. Thus, the effectiveness of the cooling system is enhanced particularly expediently.

The condenser experiences a particularly intensive cooling when, in accordance with yet another feature of the invention, the condenser is positioned at least substantially in a vicinity of the at least one supply aperture and behind the at least one supply aperture in an air flow direction.

In accordance with a concomitant feature of the invention, the ventilator is disposed between the condenser and the compressor.

Other features that are considered as characteristic for the invention are set forth in the appended claims.

Although the invention is illustrated and described herein as embodied in a cooling device for installation in a furniture niche, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
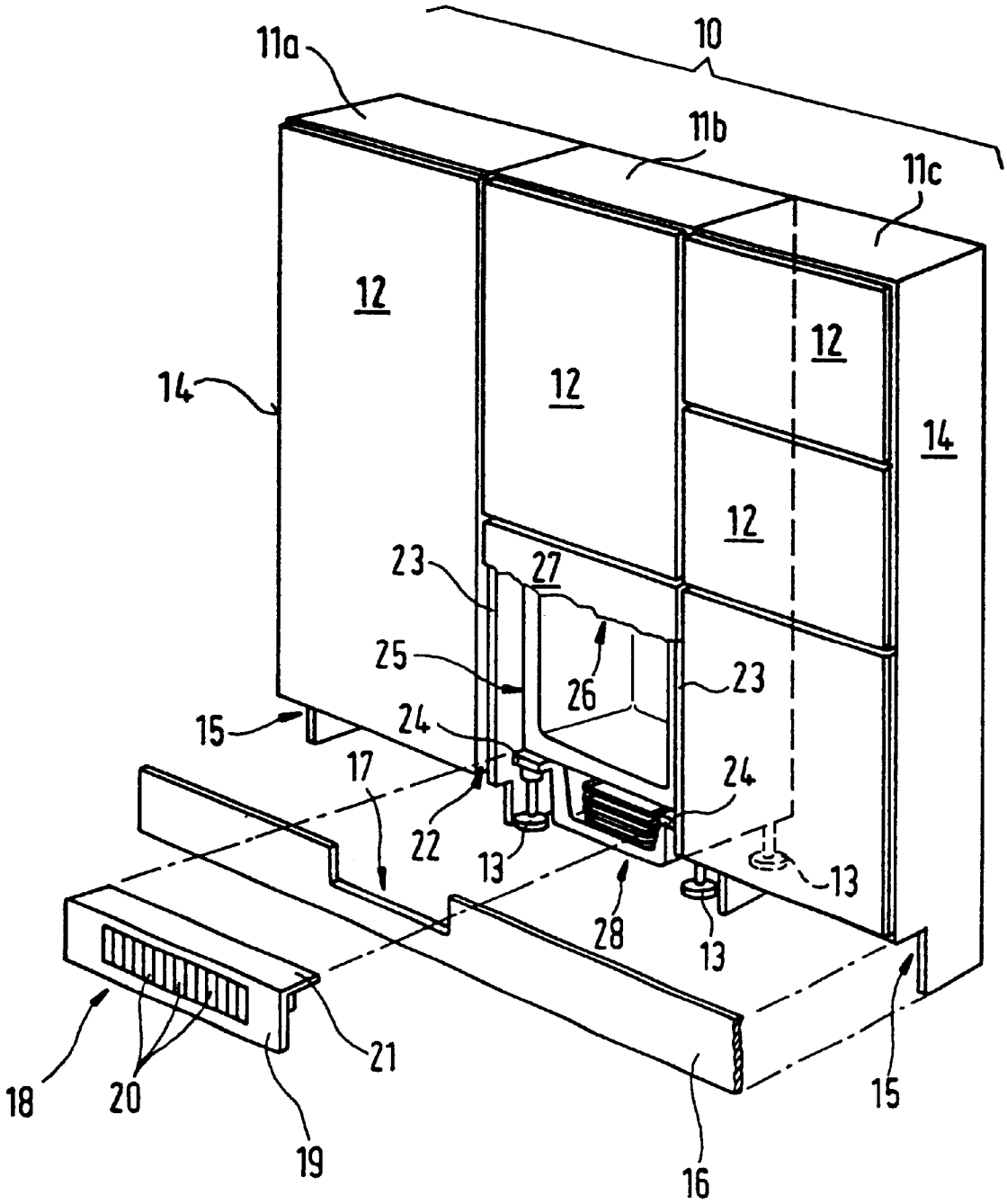
FIG. 1 is a fragmentary, front, perspective view of a kitchen unit integrated refrigerator with a base for receiving device assemblies.

In all the figures of the drawing, sub-features and integral parts that correspond to one another bear the same reference symbol in each case.

Referring now to the figures of the drawings in detail and first, particularly to FIG. 1 thereof, there is shown a kitchen unit 10 having three adjacent cabinets 11*a,* 11*b* and 11*c,* whose front is formed by doors 12 that are constructed at different heights, and whose body rests on height-adjustable feet 13 that stand on the non-illustrated floor of the kitchen. For clarity, only the feet of the center cabinet element 11*b* are shown. The cabinet elements 11*a* and 11*c* that adjoin the center element 11*b* are constructed as conventional tall cupboards including sidewalls 14, whose sides that face the kitchen floor are provided with a cutout 15 that recedes from the front of the kitchen unit 10. The cutout 15 includes a limiting surface that serves as a stop for a base facing 16 and that, in the installed condition, covers the feet 13 and gives the kitchen unit 10 a base-type or pedestal-type return. The base facing 16 includes a recess 17 that is open at the margin and oriented in its installed position approximately centrally relative to the width of the center cabinet element 11*b,* and that is covered by a ventilation blind 18 having an angular cross-section. A first leg 19 of the ventilation blind 18 extends parallel to the base facing 16 in the installed position and has ventilation slots 20, while its second leg 21, which is disposed perpendicular to the first leg 19 and points towards the kitchen unit 10 with its free end, serves for holding the ventilation blind 18 at the center cabinet element 11*b.* In contrast to its neighboring cabinet elements 11*a* and 11*c,* the center cabinet element 11*b* is constructed as a niche 22 that is formed substantially from a ceiling (not described in further detail) and a non-illustrated rear panel, as well as two side panels 23 that are disposed at least approximately at a parallel distance from each other. The inner surfaces of the side panels 23 that face each other are provided with protruding bearing strips 24 having flat profiles. The bearing strips 24 are disposed at the same height. The adjustment elements 13 are supported at the bearing strips 24. At the same time, the bearing strips 24 serve for supporting a built-in cooling device 25 including a door 26 (shown in a closed position) and whose front side is provided with a front furniture panel 27 that is adapted to the adjacent pieces of furniture. To support the built-in cooling device 25 at its housing, a rigid, self-bearing base 28 is provided, of which a first variant is shown in FIG. 2.

Figure 2:
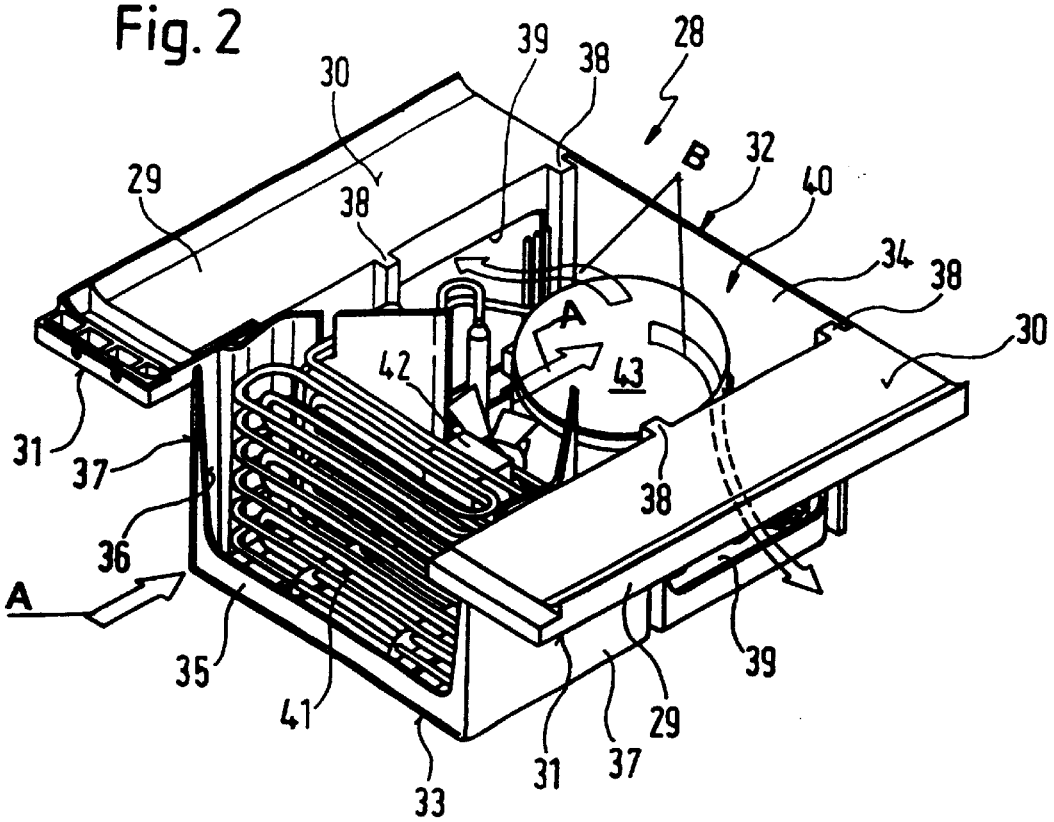
FIG. 2 is a top, perspective view of a first embodiment of the base of FIG. 1 according to the invention.

FIG. 2 illustrates the base 28 having two cantilevers 29, whose free ends are averted from each other and whose bearing surface 30, which is situated on top (when the base 28 is in the installed position), serves to support the device housing, while their bottom bearing face 31, which is situated parallel to the top bearing surface, is supported at the bearing strips 24. Besides the cantilevers 29, the base 28 includes a trough 32 that has a solid floor 33 and a solid back wall 34. Opposite the back wall 34, the base trough 32 is furnished with a front wall 35 that has an opening 36 that is disposed at least approximately across its height and width and whose longitudinal side opposite the floor 33 is constructed open at the margin. The front wall 35 and the back wall 34 are connected to each other by sidewalls 37, each of which is provided with vertically extending reinforcing ribs 38 on an interior surface that is averted from the free ends of the cantilevers 29, and each of which includes a breakthrough 39 or gap in the back region of the base 28. In the embodiment, the breakthrough 39 extends between the reinforcing ribs, which are disposed immediately adjacent the back wall 34 and the reinforcing ribs 38, which are disposed approximately midway along the length of the sidewalls. The sidewalls 37, together with the floor 33, the back wall 34, and the front wall 35, define a trough space 40, which serves to accommodate various device assemblies, namely a coiled condenser 41, a ventilator 42, and a compressor 43. The condenser 41 is disposed in the vicinity of the front wall 35 and extends at least approximately with the dimensions of the aperture 36. The ventilator 42 is disposed behind the condenser 41 in the direction of the back wall 34. The compressor 43 is disposed behind the ventilator 42 in the direction of the back wall 34 and fixed to the floor 33 of the trough 32, like the ventilator 42, and the condenser 41.

The ventilator 42 serves to force ventilate the condenser 41, which must be cooled by cold air, and, to such an end, the ventilator 42 draws cold air through the aperture 36 provided in the front wall 35 as indicated by arrow A and transports the drawn-in air forward to the downstream compressor 43, which must also be cooled. Together with the back wall 34, the compressor 43 splits the forced cold air into sub-streams and deflects the air to the breakthroughs 39 that are provided in the sidewalls 37. The breakthroughs 39 are disposed behind the configuration including the condenser 41 and the ventilator 42 in the direction of the back wall 34. The cold air that is deflected to the breakthroughs 39 (see arrows B) escapes through these and flows along the channel formed between the exterior surfaces of the sidewalls 37 and the interior surfaces of the side panels 23, before escaping from the niche 22 on the door side.

Figure 3:
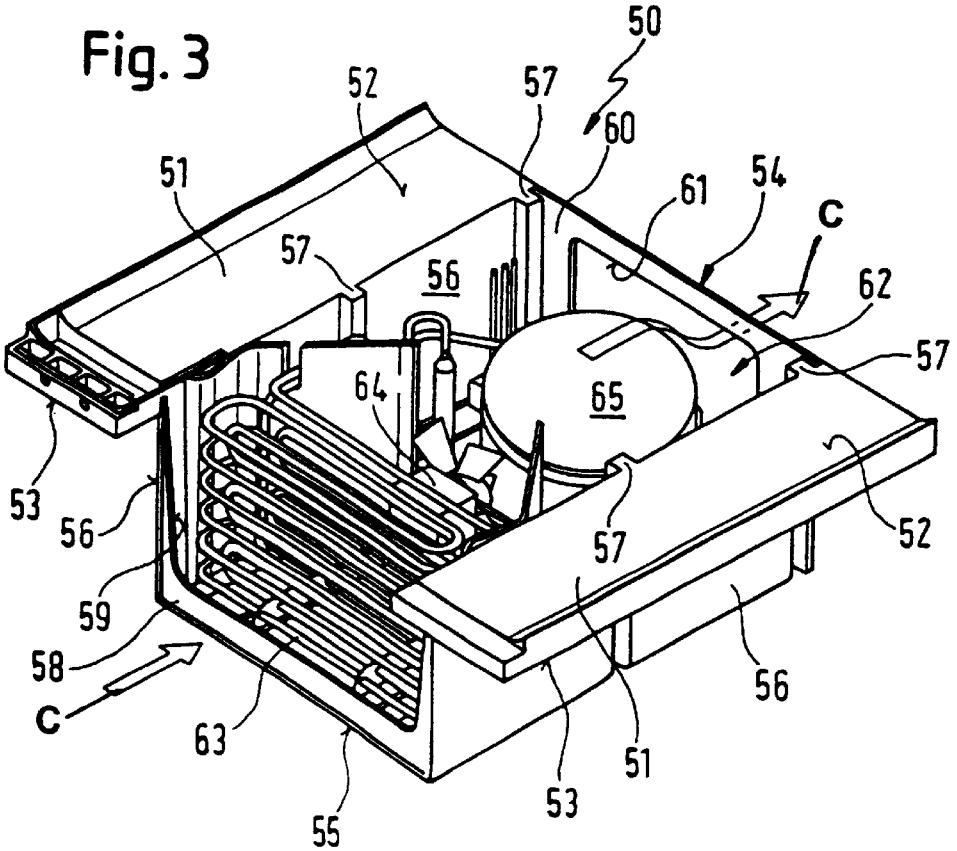
FIG. 3 is a top, perspective view of a second embodiment of the base of FIG. 2.

FIG. 3 illustrates a second exemplifying embodiment of a base 50, which, like the base 28, is equipped with two cantilevers 51. The cantilevers each have a bearing surface 52, the top surface of which in the installed position serves for supporting the housing of the built-in cooling device 25, while their bottom bearing surface 53, which is parallel to the top surface, is provided for supporting the rigid and self-bearing base 50 at the bearing strips 24. The base 50 is also equipped with a trough 54, which includes a solid floor 55 and two solid sidewalls 56. The sidewalls 56 each have vertical reinforcing ribs 57 on their interior surface, which is averted from the side panels 23. The sidewalls 56 are connected to each other at their door-side end portions by a front wall 58 having an aperture 59 that is open at the margin in the direction of bearing surfaces 52 and that serves as a ventilation opening. Opposite the front wall 58, the trough 54 includes a back wall 60 that connects the two sidewalls 56 to each other at their ends averted from the door 26. The back wall 60, like the front wall 58, has an aperture 61 having at least substantially the same area as the aperture 59 and extending in like manner at least substantially to the floor 55. The back wall 60, together with the front wall 58, the two sidewalls 56, and the floor 55, define a trough space 62 for accommodating various device assemblies, namely a coiled condenser 63, a ventilator 64, and a compressor 65. The condenser 63 is disposed in the immediate vicinity of the front wall 58 and at least substantially occupies the area of the aperture 59. The ventilator 64 is disposed behind the condenser 63 in the direction of the back wall 60. The compressor 65 is disposed behind the ventilator 64. The compressor 65 is fixed to the floor 55 of the trough 54, like the ventilator 64 and the condenser 63.

As in the first embodiment, the ventilator 64, which is disposed between the condenser 63 and the compressor 65, serves to force cool the condenser 63 by drawing cold air across the surface of the condenser 63 by way of the aperture 59 in the front wall 58 (as indicated by arrows C), from where it is subsequently fed through the ventilator 64 to the compressor 65 in order to the compressor 65. The cold air that is fed to the compressor 65 is split thereby into non-illustrated air sub-streams that sweep past the side of the compressor 65, one of which is led along the solid sidewalls 56, and one of which is led along the bottom of the cooling device housing at the base side. The two sub-streams are thereby conducted to the aperture 61 in the back wall 60. The air sub-streams that are fed to the aperture 61 in the back wall escape from the trough by way of the aperture 61 and flow into the air channel formed by the back wall of the built-in cooling device 25 and the back wall of the niche 22, through which the exhaust air that has been enriched with heat upon passing the device assemblies escapes into the standing area of the unit 10. In the second exemplifying embodiment, as in the first embodiment, the structural unit formed by the condenser 63 and the ventilator 64 is positioned in front of the aperture 61 in the back wall 60 in the flow direction of the cold air that is force driven by the ventilator.

In the embodiments, the supply apertures 36 and 59 for the cold air are spatially separated from the escape apertures 39 and 61, respectively, in the trough space 40 and 62, respectively, to at least substantially prevent a mixing of the cold air that flows into the trough space 40 and 62 with the hot exhaust air that flows therefrom.

We claim:

1. A cooling device for installation in a furniture niche, comprising:

at least one thermally insulating container defining a cooling space and having a door for sealing said cooling space;

a cooling apparatus including a compressor, a condenser, and a ventilator;

a base having:

at least two sidewalls;

a front region disposed in a vicinity of said door;

a rear region;

at least one air supply aperture disposed at said front region; and an exhaust aperture disposed at said rear region;

said base housing said compressor, said condenser, and said ventilator;

said base being disposed below said cooling space;

said base being force ventilated by said ventilator through said at least one air supply aperture and said exhaust aperture; and said exhaust aperture being disposed in at least one of said sidewalls.

2. The cooling device according to claim 1, wherein:

said exhaust aperture is at least two exhaust apertures;

said sidewalls each have a sidewall rear region in a vicinity of said rear region of said base; and at least one of said at least two exhaust apertures is disposed in said sidewall rear region of one of said sidewalls.

3. The cooling device according to claim 1, wherein:

said base has a back wall at said rear region; and said exhaust aperture is disposed in at least one of said sidewalls immediately adjacent said back wall.

4. The cooling device according to claim 2, wherein:

said base has a back wall at said rear region; and one of said at least two exhaust apertures is disposed in a respective one of said sidewalls immediately adjacent said back wall.

5. The cooling device according to claim 1, wherein:

said front region of said base has a front wall defining said at least one supply aperture;

said front wall has a width; and said at least one supply aperture extends at least substantially across said width of said front wall.

6. The cooling device according to claim 1, wherein said condenser is positioned at least substantially in a vicinity of said at least one supply aperture and behind said at least one supply aperture in an air flow direction.

7. The cooling devices according to claim 1, wherein said ventilator is disposed between said condenser and said compressor.

8. A cooling device for installation in a niche of a kitchen unit, comprising:

at least one thermally insulating container defining a cooling space and having a door for sealing said cooling space;

a cooling apparatus including a compressor, a condenser, and a ventilator;

a base having:

at least two sidewalls;

a front region disposed in a vicinity of said door;

a rear region;

at least one air supply aperture disposed at said front region; and an exhaust aperture disposed at said rear region;

said base housing said compressor, said condenser, and said ventilator;

said base being disposed below said cooling space;

said base being force ventilated by said ventilator through said at least one air supply aperture and said exhaust aperture; and said exhaust aperture being disposed in at least one of said sidewalls.

* * * * *